US012351959B2

(12) United States Patent
Lee

(10) Patent No.: US 12,351,959 B2
(45) **Date of Patent: *Jul. 8, 2025**

(54) PROTECTIVE CLOTH WITH MOISTURE PERMEABILITY AND MANUFACTURING METHOD THEREOF

(71) Applicant: QUANN CHENG INTERNATIONAL CO., LTD., Pingtung (TW)

(72) Inventor: Hsing-Hsun Lee, Kaohsiung (TW)

(73) Assignee: QUANN CHENG INTERNATIONAL CO., LTD., Pingtung (TW)

( * ) Notice: Subject to any disclaimer, the term of this patent is extended or adjusted under 35 U.S.C. 154(b) by 709 days.

This patent is subject to a terminal disclaimer.

(21) Appl. No.: 17/477,519

(22) Filed: Sep. 16, 2021

(65) Prior Publication Data

US 2023/0050800 A1 Feb. 16, 2023

(30) Foreign Application Priority Data

Aug. 10, 2021 (TW) ..... 110129502

(51) Int. Cl.
*D04H 1/74* (2006.01)
*D04H 1/541* (2012.01)

(52) U.S. Cl.
CPC ..... *D04H 1/74* (2013.01); *D04H 1/5412* (2020.05); *D10B 2401/02* (2013.01); *D10B 2401/063* (2013.01); *D10B 2401/13* (2013.01)

(58) Field of Classification Search
CPC ..... B29C 2045/1692; B29C 41/08; B29C 44/326; B29C 45/14786; B29C 48/0021; B29C 51/004; B29C 53/12; B29C 53/14; B29C 64/147; B29C 65/3456; B29C 65/3656; B29C 66/433; B29C 66/45; B29C 70/30; B29C 70/304; B29C 70/502; B29C 70/508; B29C 70/685
See application file for complete search history.

*Primary Examiner* — Stella K Yi
(74) *Attorney, Agent, or Firm* — Leong C. Lei

(57) ABSTRACT

This application relates to a protective cloth with moisture permeability and a manufacturing method thereof. The method includes: providing a first fiber thread and a second fiber thread; respectively forming a moisture-permeable membrane on a surface of an arrangement layer formed by the first fiber thread and a surface of an arrangement layer formed by the second fiber thread; and combining the first fiber thread and the second fiber thread in pairs by intersecting and laminating to form laminated bonding, where the first fiber thread and the second fiber thread with the moisture-permeable membrane are used as two opposite surface layers of the laminated bonding to allow the laminated bonding to form a corresponding moisture-permeable membrane layer. This application provides a high-level protective cloth with excellent moisture permeability and protective performance, and optimizes the moisture permeability of the protective cloth.

17 Claims, 6 Drawing Sheets

PROTECTIVE CLOTH WITH MOISTURE PERMEABILITY AND MANUFACTURING METHOD THEREOF

CROSS-REFERENCE TO RELATED APPLICATION

This application claims the benefit of Taiwan Patent Application No. 110129502, filed on Aug. 10, 2021, which is hereby incorporated by reference for all purposes as if fully set forth herein.

BACKGROUND

Technical Field

This application relates to the technical field of protective cloths, and specifically, to a protective cloth with moisture permeability and a manufacturing method thereof.

Related Art

Textiles in daily life are usually in contact with bodies of users. With the improvement of the standard of living and the rise of awareness of health of people, functional textiles with antibacterial, antifungus, or deodorant effects are increasingly popular in the market. Protective cloths generally have antibacterial, antifungus, or deodorant effects, but generally have poor moisture permeability. Based on this, this specification provides a high-strength protective cloth with moisture permeability and a manufacturing method thereof make up for the shortcomings of the related art.

SUMMARY

In view of the disadvantages of the related art, this application discloses a protective cloth with moisture permeability and a manufacturing method thereof, to resolve the problem that protective cloths generally have antibacterial, antifungus, or deodorant effects, but generally have poor moisture permeability.

This application is achieved through the following technical solution:

In order to achieve the above objective, this application provides a method for manufacturing a protective cloth with moisture permeability. The method comprises the following steps:

providing a first fiber thread and a second fiber thread, wherein the first fiber thread is a core-spun yarn formed by a blended slurry, a nano metal solution, a plurality of inorganic particles, and a plurality of thermoplastic polyurethane colloidal particles, the thermoplastic polyurethane colloidal particles are hot melted and then wrapped around a peripheral side of a core thread of the core-spun yarn for isolation from an outer wrapping layer of the core-spun yarn, and the second fiber thread is the same as the first fiber thread or is a single-thread yarn formed by the blended slurry and the nano metal solution;

respectively forming a moisture-permeable membrane on a surface of an arrangement layer formed by the first fiber thread and a surface of an arrangement layer formed by the second fiber thread; and combining the first fiber thread and the second fiber thread in pairs by intersecting and laminating to form laminated bonding, wherein the first fiber thread and the second fiber thread with the moisture-permeable membrane are used as two opposite surface layers of the laminated bonding to allow the laminated bonding to form a corresponding moisture-permeable membrane layer.

Formation of the moisture-permeable membrane further comprises one or more of the following:

forming the moisture-permeable membrane between one or more pairs of the first fiber thread and the second fiber thread; and forming the moisture-permeable membrane between some or all of adjacent pairs.

The step of respectively forming a moisture-permeable membrane on a surface of an arrangement layer formed by the first fiber thread and a surface of an arrangement layer formed by the second fiber thread comprises: respectively contacting the surface of the arrangement layer formed by the first fiber thread and the surface of the arrangement layer formed by the second fiber thread with a high-molecular-weight polyethylene spinning solution and then cooling, to respectively form the moisture-permeable membrane on the surface of the arrangement layer formed by the first fiber thread and the surface of the arrangement layer formed by the second fiber thread.

An arrangement angle of each pair of the first fiber thread and the second fiber thread is orthogonal, and arrangement modes of adjacent pairs are different.

A method for forming the core-spun yarn comprises the following steps:

(A) mixing and stirring the blended slurry, the nano metal solution, the inorganic particles, and the thermoplastic polyurethane colloidal particles to form a mixed material, wherein the nano metal solution comprises first metal ions and comes into contact with the blended slurry to form a first metal ion fiber comprising the first metal ions;

(B) bringing a second metal into contact with the first metal ion fiber, so that the first metal ions undergo a reduction reaction to obtain a nano copper fiber yarn, wherein the nano copper fiber yarn comprises first metal nanoparticles obtained by means of the reduction of the first metal ions;

(C) drying the mixed material to remove moisture, and performing hot-melt spinning on the mixed material in a spinning machine, to obtain yarns from an outlet of the spinning machine to form the core thread, wherein the thermoplastic polyurethane colloidal particles are hot melted and then wrapped around the peripheral side of the core thread obtained from the outlet to form a first-stage thread;

(D) shaping a surface of the first-stage thread by performing first cooling on the first-stage thread;

(E) stretching and extending the cooled first-stage thread by using a tensile device;

(F) repeating step (A) and step (B) on the first-stage thread, and wrapping the mixed material around a periphery of the first-stage thread;

(G) shaping an inside of the first-stage thread by performing second cooling on the first-stage thread, to form a second-stage thread; and (I) collecting the second-stage thread to form a deodorant and antibacterial nano copper fiber yarn, wherein the deodorant and antibacterial nano copper fiber yarn is the first fiber thread or the first fiber thread and the second fiber thread.

A method for forming the single-thread yarn comprises the following steps:

(A) mixing and stirring the blended slurry and the nano metal solution to form a mixed material, wherein the nano metal solution comprises first metal ions and comes into contact with the blended slurry to form a first metal ion fiber comprising the first metal ions;

(B) bringing a second metal into contact with the first metal ion fiber, so that the first metal ions undergo a reduction reaction to obtain a nano copper fiber yarn, wherein the nano copper fiber yarn comprises first metal nanoparticles obtained by means of the reduction of the first metal ions;

(C) drying the mixed material to remove moisture, and performing hot-melt spinning on the mixed material in a spinning machine, to obtain yarns from an outlet of the spinning machine to form the single-thread yarn;

(D) shaping the single-thread yarn by performing cooling on the single-thread yarn; and (E) collecting the single-thread yarn to form the second fiber thread.

The blended slurry comprises a first fiber yarn slurry and a second fiber yarn slurry, the first fiber yarn slurry is selected from a cotton fiber, a polyester fiber, a viscose fiber and a Modal fiber, an ultra-high-molecular-weight polyethylene fiber, and a polypropylene fiber, and the second fiber yarn slurry is selected from an aromatic polyamide fiber, a polyamide fiber, a polyethylene terephthalate fiber, a polyethylene naphthalate fiber, an extended-chain polyvinyl alcohol fiber, an extended-chain polyacrylonitrile fiber, a polybenzoxazole fiber, a polybenzothiazole fiber, a liquid-crystal copolyester fiber, a rigid-rod fiber, a glass fiber, a structural glass fiber, and a resistant glass fiber.

The thermoplastic polyurethane colloidal particles comprise thermoplastic polyurethane, polyethylene, polypropylene, polyethylene terephthalate, polyamide, polybutylene terephthalate, an ethylene-vinyl acetate copolymer or nylon, and copper modified polyacrylonitrile.

The plurality of inorganic particles is rare earth or mineral particle powder.

The first metal ions are copper ions, and the second metal comprises magnesium, aluminum, manganese, titanium, zinc, iron, nickel, tin, copper, or silver.

A standard reduction potential of the first metal ions is greater than a standard reduction potential of the second metal in an ionic state, and a standard reduction potential difference of the first metal ions is 0.4-4 volts greater than a standard reduction potential difference of the second metal in the ionic state.

A temperature for drying in step C is controlled between 100° C. and 150° C.

The first cooling in step D means that the first-stage thread continuously passes through a cooling tank over a period of time, and the second cooling in step G is natural air cooling.

The cooling in step D means that the single-thread yarn continuously passes through a cooling tank over a period of time.

In step E, the tensile device comprises a plurality of roller sets arranged in sequence to stretch the first-stage thread.

This application further aims to provide a protective cloth with moisture permeability, manufactured by using the method for manufacturing a protective cloth with moisture permeability.

This application has the following beneficial effects:

This application provides a high-level protective cloth with excellent moisture permeability and protective performance. A moisture-permeable membrane is respectively formed on a surface of an arrangement layer formed by a first fiber thread and a surface of an arrangement layer formed by a second fiber thread, and during laminating, the moisture-permeable membrane is formed between one or more pairs of the first fiber thread and the second fiber thread, or the moisture-permeable membrane is formed between some or all of adjacent pairs, to optimize the moisture permeability of the protective cloth.

BRIEF DESCRIPTION OF THE DRAWINGS

To describe the technical solutions of embodiments of this application or the related art more clearly, the following briefly introduces the accompanying drawings required for describing the embodiments or the related art. Apparently, the accompanying drawings in the following description show only some embodiments of this application, and a person of ordinary skill in the art may still derive other drawings from these accompanying drawings without creative efforts.

DETAILED DESCRIPTION

In order to make objectives, technical solutions, and advantages of embodiments of this application more clearly, the technical solutions in the embodiments of this application will be clearly and completely described in the following with reference to the accompanying drawings in the embodiments of this application. It is obvious that the embodiments to be described are only some rather than all of the embodiments of this application. All other embodiments obtained by a person of ordinary skill in the art based on the embodiments of this application without making creative efforts shall fall within the protection scope of this application.

Figure 1:
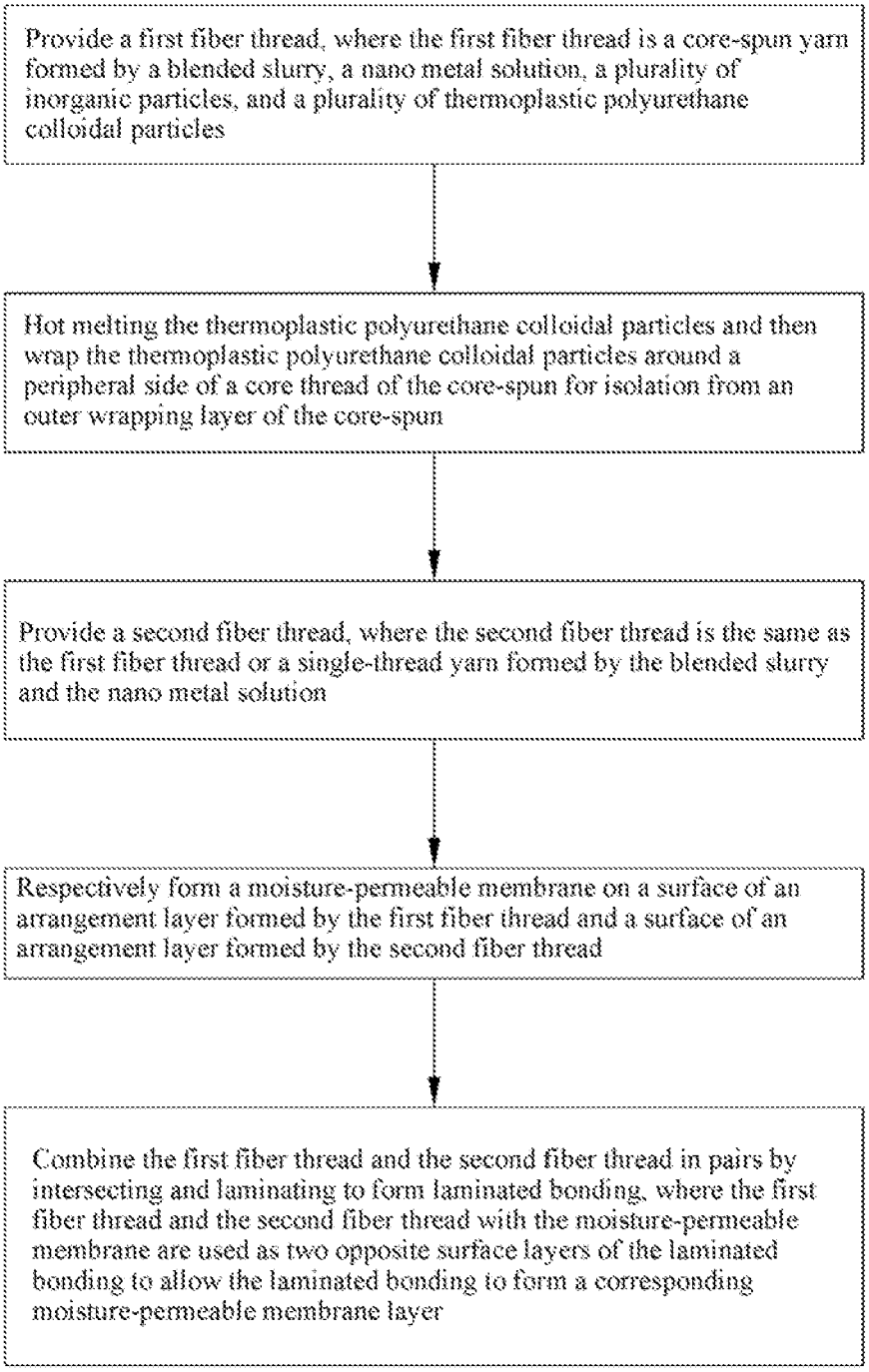
FIG. 1 is a flowchart of steps of a method for manufacturing a protective cloth with moisture permeability according to an embodiment of this application.

FIG. 1 is a flowchart of steps of a method for manufacturing a protective cloth with moisture permeability according to this application. The method includes: providing a first fiber thread and a second fiber thread, where the first fiber thread is a core-spun yarn formed by a blended slurry, a nano metal solution, a plurality of inorganic particles, and a plurality of thermoplastic polyurethane colloidal particles, the thermoplastic polyurethane colloidal particles are hot melted and then wrapped around a peripheral side of a core thread of the core-spun yarn for isolation from an outer wrapping layer of the core-spun yarn, and the second fiber thread is the same as the first fiber thread or is a single-thread yarn formed by the blended slurry and the nano metal solution.

Figure 2:
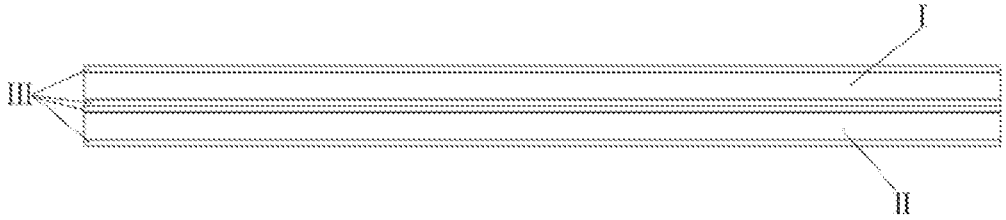
FIG. 2 is a diagram of a corresponding moisture-permeable membrane layer formed by laminated bonding according to an embodiment of this application.

FIG. 2 shows a plurality of bonding layers formed by intersecting and laminating the first fiber thread and the second fiber thread.

In an embodiment, bonding arrangement angles in the layers are as follows: arrangement angles of the first fiber thread in a first layer I, a third layer III, and a fifth layer V are successively 0°, 225°, and 135°, and arrangement angles of the second fiber thread in a second layer II, a fourth layer IV, and a sixth layer VI are successively 90°, 315°, and 225°.

In an embodiment, bonding arrangement angles in the layers are as follows: arrangement angles of the first fiber thread in a first layer I, a third layer III, and a fifth layer V are successively 0°, 210°, and 150°, and arrangement angles of the second fiber thread in a second layer II, a fourth layer IV, and a sixth layer VI are successively 90°, 300°, and 240°.

In an embodiment, bonding arrangement angles in the layers are as follows: arrangement angles of the first fiber thread in a first layer I, a third layer III, and a fifth layer V are successively 0°, 240°, and 120°, and arrangement angles of the second fiber thread in a second layer II, a fourth layer IV, and a sixth layer VI are successively 90°, 330°, and 210°.

In an embodiment, the blended slurry includes a first fiber yarn slurry and a second fiber yarn slurry, the first fiber yarn slurry is selected from a cotton fiber, a polyester fiber, a viscose fiber and a Modal fiber, an ultra-high-molecular-weight polyethylene fiber, and a polypropylene fiber.

In an embodiment, the second fiber yarn slurry is selected from an aromatic polyamide fiber, a polyamide fiber, a polyethylene terephthalate fiber, a polyethylene naphthalate fiber, an extended-chain polyvinyl alcohol fiber, an extended-chain polyacrylonitrile fiber, a polybenzoxazole (PBO) fiber, a polybenzothiazole (PBT) fiber, a liquid-crystal copolyester fiber, a rigid-rod fiber, a glass fiber, a structural glass fiber, and a resistant glass fiber.

In an embodiment, the aromatic polyamide fiber is preferably a p-aromatic polyamide fiber, and the rigid-rod fiber is preferably an M5® fiber.

In an embodiment, the glass fiber includes an electrical glass fiber, which uses E-glass, such as low alkali metal borosilicate glass having a desirable electrical property.

In an embodiment, the structural glass fiber uses S-glass, such as magnesium oxide-alumina-silicate glass.

In an embodiment, the resistant glass fiber uses R-glass, such as aluminosilicate glass without magnesium oxide or calcium oxide.

In an embodiment, each one of the foregoing fiber types is generally known in the art. A copolymer, a block copolymer, and a blend of the foregoing materials are also applicable to manufacture of a group consisting of polymeric fibers.

In an embodiment, the thermoplastic polyurethane colloidal particles include thermoplastic polyurethane, polyethylene, polypropylene, polyethylene terephthalate, polyamide, polybutylene terephthalate, an ethylene-vinyl acetate copolymer or nylon, and copper modified polyacrylonitrile.

In an embodiment, the plurality of inorganic particles is rare earth or mineral particle powder.

In an embodiment, the first metal ions are copper ions, and the second metal includes magnesium, aluminum, manganese, titanium, zinc, iron, nickel, tin, copper, or silver.

Figure 5:
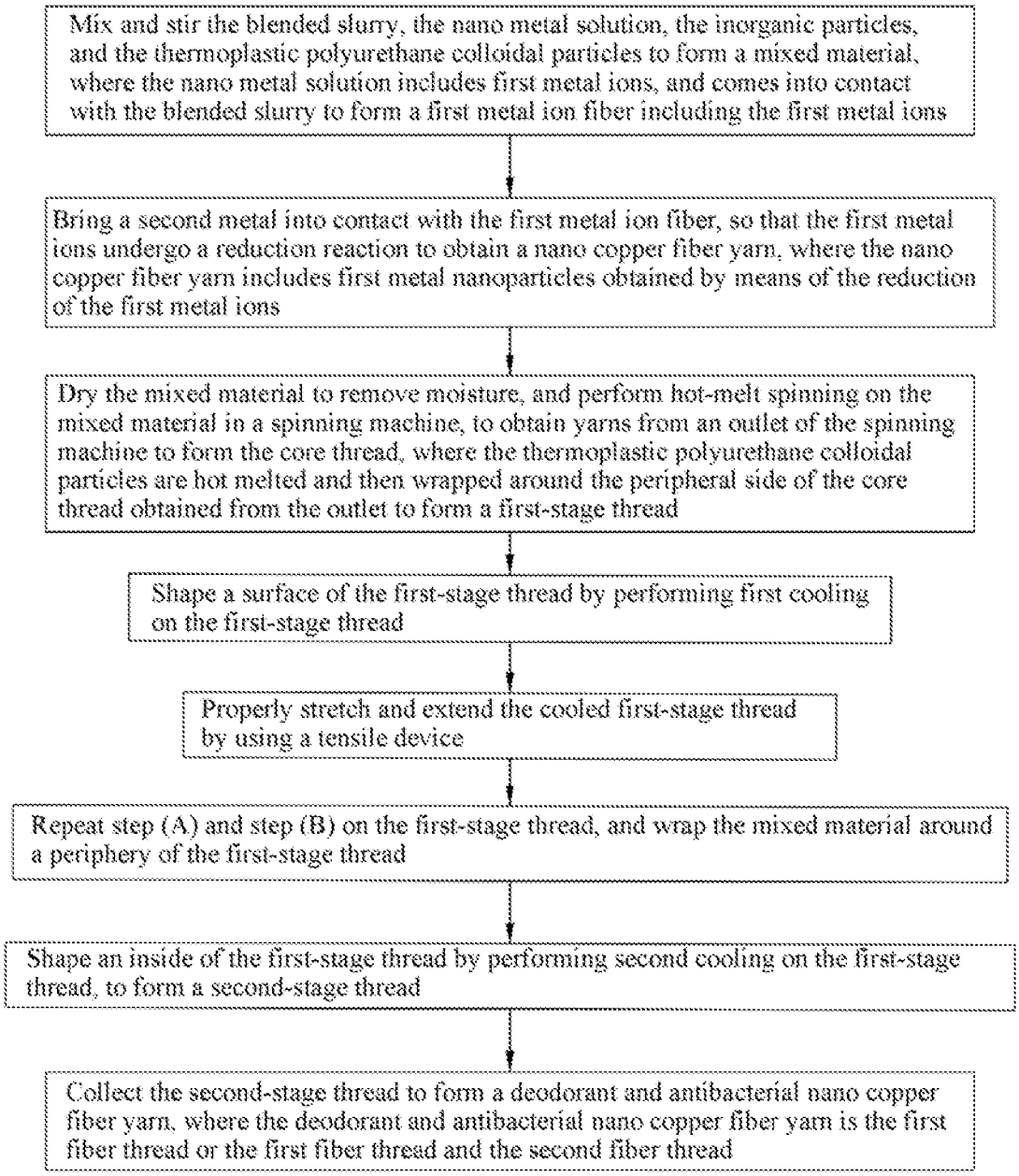
FIG. 5 is a flowchart of steps of a method for forming a core-spun yarn according to an embodiment of this application.

As shown in FIG. 5, a device system corresponding to a method for manufacturing a deodorant and antibacterial nano copper fiber yarn in this embodiment provides a raw material 1. The raw material 1 includes a blended slurry 11, a nano metal solution 12, a plurality of inorganic particles 13, and a plurality of thermoplastic polyurethane colloidal particles 14. The blended slurry 11 includes a first fiber yarn slurry 111 and a second fiber yarn slurry 112. The nano metal solution 12 includes first metal ions 121.

Further, the raw material 1 is mixed and stirred in a mixing tank 11 to form a mixed material 2, so that the nano metal solution 12 comes into contact with the blended slurry 11 to form a first metal ion fiber 21 including the first metal ions.

Further, a second metal 3 is brought into contact with the first metal ion fiber 21, so that the first metal ions undergo a reduction reaction. Thus, the first metal ion fiber 21 obtains electrons so as to obtain the nano copper fiber yarn. The nano copper fiber yarn includes first metal nanoparticles obtained by means of the reduction of the first metal ions.

In an embodiment, the second metal may include magnesium, aluminum, manganese, titanium, zinc, iron, nickel, tin, copper, or silver.

Further, the mixed material 2 is dried to remove moisture. The drying operation may be performed in an oven B, and a temperature in the oven B may be controlled between 100° C. and 150° C. However, the temperature control is not limited thereto.

Further, the mixed material 2 is delivered to a spinning machine C, and hot-melt spinning is performed on the mixed material 2 by using the spinning machine C, so as to obtain a yarn 4 from an outlet of the spinning machine C to form a primary thread. The thermoplastic polyurethane colloidal particles 14 are hot melted by the spinning machine C, and then may be further wrapped around a peripheral side of the primary thread at the outlet of the spinning machine C (shown in FIG. 6), so as to form a first-stage thread 5.

Further, the first-stage thread 5 is delivered to a cooling tank D for forced cooling, which is first cooling, so as to shape a surface of the first-stage thread 5.

Further, the first-stage thread 5 after the first cooling is delivered to a tensile device E for stretching and extending the cooled first-stage thread 5, so as to control a thread diameter to be proper.

In an embodiment, the tensile device E includes a plurality of roller sets arranged in sequence, and the first-stage thread 5 is wound around the roller sets for stretching, so as to control the thread diameter.

Further, second cooling such as natural air cooling is performed on the first-stage thread 5. By means of the cooling, an inside of the first-stage thread 5 can be shaped to form a second-stage thread 6.

Further, the second-stage thread 6 is collected. For example, the second-stage thread 6 may be wound into a roll shape by winding the yarns, so as to form a deodorant and antibacterial nano copper fiber yarn product.

Further, the first fiber yarn slurry 111 may be one from a group consisting of a cotton fiber, a polyester fiber, a viscose fiber, and a Modal fiber, such as a single fiber or a combination of any of the foregoing fibers.

Figure 6:
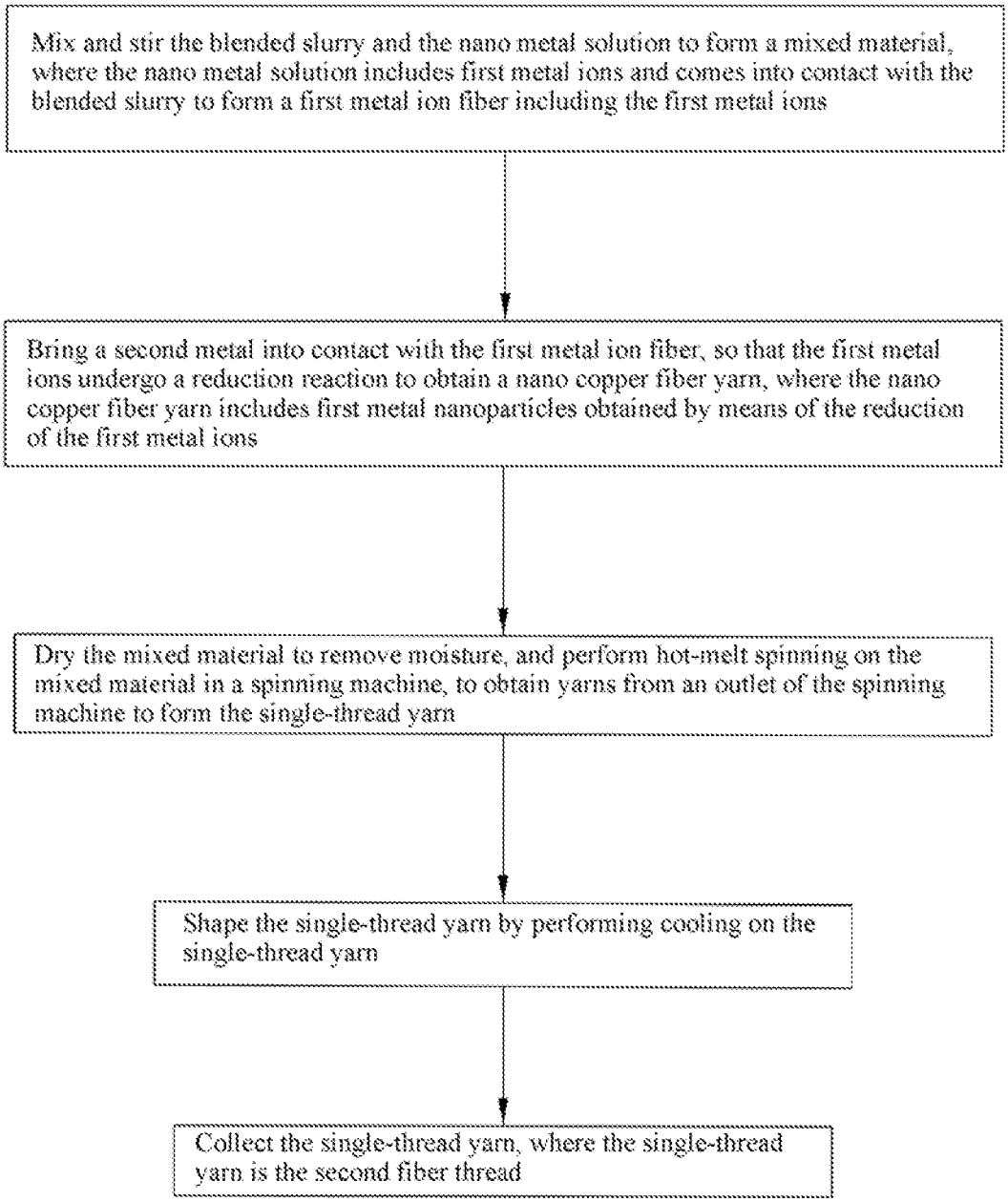
FIG. 6 is a flowchart of steps of a method for forming a single-thread yarn according to an embodiment of this application.

As shown in FIG. 6, the deodorant and antibacterial nano copper fiber yarn in this embodiment is the second-stage thread 6 manufactured by using the manufacturing method in the foregoing embodiments. An average particle size of the first metal nanoparticles is 1 nanometer to 100 nanometers. In addition, a content of the first metal nanoparticles included in the nano copper fiber yarn in the second-stage thread 6 is 10 micrograms to 100 micrograms per square centimeter of a fiber surface.

Figure 3:
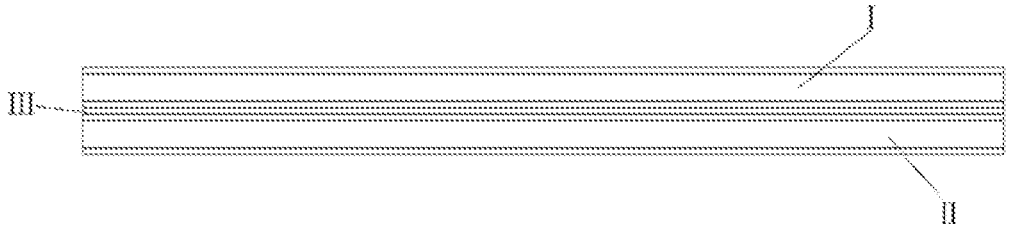
FIG. 3 is a diagram of forming a moisture-permeable membrane between one or more pairs of a first fiber thread and a second fiber thread according to an embodiment of this application.

As shown in FIG. 3, a method for forming the core-spun yarn in this embodiment includes the following steps:

(A) mixing and stirring the blended slurry, the nano metal solution, the inorganic particles, and the thermoplastic polyurethane colloidal particles to form a mixed material, where the nano metal solution includes first metal ions and comes into contact with the blended slurry to form a first metal ion fiber including the first metal ions;

(B) bringing a second metal into contact with the first metal ion fiber, so that the first metal ions undergo a reduction reaction to obtain a nano copper fiber yarn, where the nano copper fiber yarn includes first metal nanoparticles obtained by means of the reduction of the first metal ions;

(C) drying the mixed material to remove moisture, and performing hot-melt spinning on the mixed material in a spinning machine, to obtain yarns from an outlet of the spinning machine to form the core thread, where the thermoplastic polyurethane colloidal particles are hot melted and then wrapped around the peripheral side of the core thread obtained from the outlet to form a first-stage thread;

(D) shaping a surface of the first-stage thread by performing first cooling on the first-stage thread;

(E) stretching and extending the cooled first-stage thread by using a tensile device;

(F) repeating step (A) and step (B) on the first-stage thread, and wrapping the mixed material around a periphery of the first-stage thread;

(G) shaping an inside of the first-stage thread by performing second cooling on the first-stage thread, to form a second-stage thread; and (I) collecting the second-stage thread to form a deodorant and antibacterial nano copper fiber yarn, where the deodorant and antibacterial nano copper fiber yarn is the first fiber thread or the first fiber thread and the second fiber thread.

In an embodiment, the first cooling in step D means that the first-stage thread continuously passes through a cooling tank over a period of time, and the second cooling in step G is natural air cooling.

In an embodiment, a standard reduction potential of the first metal ions is greater than a standard reduction potential of the second metal in an ionic state, and a standard reduction potential difference of the first metal ions is 0.4-4 volts greater than a standard reduction potential difference of the second metal in the ionic state.

In an embodiment, a temperature for drying in step C is controlled between 100° C. and 150° C.

In an embodiment, in step E, the tensile device includes a plurality of roller sets arranged in sequence to stretch the first-stage thread.

Figure 4:
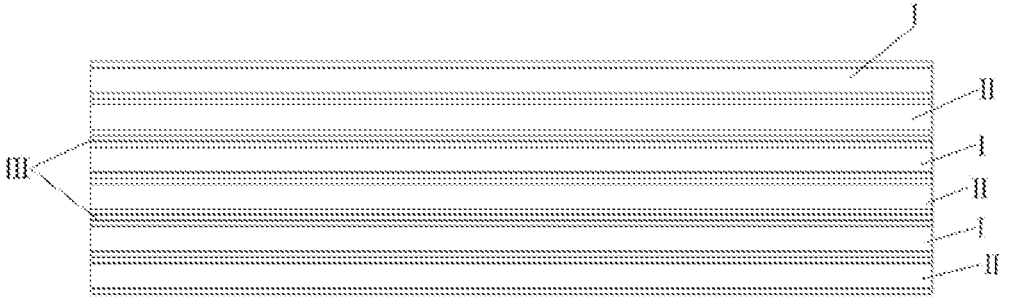
FIG. 4 is a diagram of forming a moisture-permeable membrane between some or all of adjacent pairs according to an embodiment of this application.

As shown in FIG. 4, a method for forming the single-thread yarn in this embodiment includes the following steps:

(A) mixing and stirring the blended slurry and the nano metal solution to form a mixed material, where the nano metal solution includes first metal ions and comes into contact with the blended slurry to form a first metal ion fiber including the first metal ions;

(B) bringing a second metal into contact with the first metal ion fiber, so that the first metal ions undergo a reduction reaction to obtain a nano copper fiber yarn, where the nano copper fiber yarn includes first metal nanoparticles obtained by means of the reduction of the first metal ions;

(C) drying the mixed material to remove moisture, and performing hot-melt spinning on the mixed material in a spinning machine, to obtain yarns from an outlet of the spinning machine to form the single-thread yarn;

(D) shaping the single-thread yarn by performing cooling on the single-thread yarn; and (E) collecting the single-thread yarn, where the single-thread yarn is the second fiber thread.

In an embodiment, the cooling in step D means that the single-thread yarn continuously passes through a cooling tank over a period of time.

In an embodiment, a standard reduction potential of the first metal ions is greater than a standard reduction potential of the second metal in an ionic state, and a standard reduction potential difference of the first metal ions is 0.4-4 volts greater than a standard reduction potential difference of the second metal in the ionic state.

In an embodiment, a temperature for drying in step C is controlled between 100° C. and 150° C.

By means of the method for manufacturing a protective cloth with moisture permeability in the embodiments of this application, a protective cloth with moisture permeability can be manufactured.

According to the above, a nanoscale fiber thread may be obtained by simply performing the process of this application at a room temperature without requiring expensive environment control devices. Therefore, this application has low costs, and can reduce energy consumption and high thermal pollution. The obtained first fiber thread and second fiber thread are intersected and laminated to form a plurality of bonding layers, so as to form the deodorant and antibacterial protective cloth. By means of the laminated arrangement, flexibility of an original fiber thread is maintained, the protective cloth has a very high strength, which is unlikely to be pierced, so that a protection factor is increased, and the laminated arrangement enables desirable breathability for the protective cloth, so that the protective cloth has a deodorant effect. Since the protective cloth is made of the fiber threads, and the fiber threads have strong antibacterial properties, the protective cloth also has a desirable antibacterial effect. FIG. 1 shows a flowchart of steps of a method for manufacturing a protective cloth with moisture permeability according to this application. The method includes the following steps:

providing a first fiber thread and a second fiber thread, where the first fiber thread is a core-spun yarn formed by a blended slurry, a nano metal solution, a plurality of inorganic particles, and a plurality of thermoplastic polyurethane colloidal particles, the thermoplastic polyurethane colloidal particles are hot melted and then wrapped around a peripheral side of a core thread of the core-spun yarn for isolation from an outer wrapping layer of the core-spun yarn, and the second fiber thread is the same as the first fiber thread or is a single-thread yarn formed by the blended slurry and the nano metal solution;

respectively forming a moisture-permeable membrane III on a surface of an arrangement layer formed by the first fiber thread I and a surface of an arrangement layer formed by the second fiber thread II (as shown in FIG. 2); and combining the first fiber thread I and the second fiber thread II in pairs by intersecting and laminating to form laminated bonding, where the first fiber thread I and the second fiber thread II with the moisture-permeable membrane are used as two opposite surface layers of the laminated bonding to allow the laminated bonding to form a corresponding moisture-permeable membrane III layer (as shown in FIG. 2).

As shown in FIG. 3, in this embodiment, the moisture-permeable membrane III is formed between one or more pairs of the first fiber thread I and the second fiber thread II.

As shown in FIG. 4, in this embodiment, the moisture-permeable membrane III is formed between some or all of adjacent pairs.

In an embodiment, the step of respectively forming a moisture-permeable membrane on a surface of an arrangement layer formed by the first fiber thread and a surface of an arrangement layer formed by the second fiber thread includes: respectively contacting the surface of the arrangement layer formed by the first fiber thread and the surface of the arrangement layer formed by the second fiber thread with a high-molecular-weight polyethylene spinning solution and then cooling, to respectively form the moisture-permeable membrane on the surface of the arrangement layer formed by the first fiber thread and the surface of the arrangement layer formed by the second fiber thread.

In an embodiment, an arrangement angle of each pair of the first fiber thread and the second fiber thread is orthogonal, and arrangement modes of adjacent pairs are different.

In an embodiment, the blended slurry includes a first fiber yarn slurry and a second fiber yarn slurry, the first fiber yarn slurry is selected from a cotton fiber, a polyester fiber, a viscose fiber and a Modal fiber, an ultra-high-molecular-weight polyethylene fiber, and a polypropylene fiber.

In an embodiment, the second fiber yarn slurry is selected from an aromatic polyamide fiber, a polyamide fiber, a polyethylene terephthalate fiber, a polyethylene naphthalate fiber, an extended-chain polyvinyl alcohol fiber, an extended-chain polyacrylonitrile fiber, a polybenzoxazole (PBO) fiber, a polybenzothiazole (PBT) fiber, a liquid-crystal copolyester fiber, a rigid-rod fiber, a glass fiber, a structural glass fiber, and a resistant glass fiber.

In an embodiment, the aromatic polyamide fiber is preferably a p-aromatic polyamide fiber, and the rigid-rod fiber is preferably an M5® fiber.

In an embodiment, the glass fiber includes an electrical glass fiber, which uses E-glass, such as low alkali metal borosilicate glass having a desirable electrical property.

In an embodiment, the structural glass fiber uses S-glass, such as magnesium oxide-alumina-silicate glass.

In an embodiment, the resistant glass fiber uses R-glass, such as aluminosilicate glass without magnesium oxide or calcium oxide.

In an embodiment, each one of the foregoing fiber types is generally known in the art. A copolymer, a block copolymer, and a blend of the foregoing materials are also applicable to manufacture of a group consisting of polymeric fibers.

In an embodiment, the thermoplastic polyurethane colloidal particles include thermoplastic polyurethane, polyethylene, polypropylene, polyethylene terephthalate, polyamide, polybutylene terephthalate, an ethylene-vinyl acetate copolymer or nylon, and copper modified polyacrylonitrile.

In an embodiment, the plurality of inorganic particles is rare earth or mineral particle powder.

In an embodiment, the first metal ions are copper ions, and the second metal includes magnesium, aluminum, manganese, titanium, zinc, iron, nickel, tin, copper, or silver.

As shown in FIG. 5, a method for forming the core-spun yarn in this embodiment includes the following steps:

(A) mixing and stirring the blended slurry, the nano metal solution, the inorganic particles, and the thermoplastic polyurethane colloidal particles to form a mixed material, where the nano metal solution includes first metal ions and comes into contact with the blended slurry to form a first metal ion fiber including the first metal ions;

(B) bringing a second metal into contact with the first metal ion fiber, so that the first metal ions undergo a reduction reaction to obtain a nano copper fiber yarn, where the nano copper fiber yarn includes first metal nanoparticles obtained by means of the reduction of the first metal ions;

(C) drying the mixed material to remove moisture, and performing hot-melt spinning on the mixed material in a spinning machine, to obtain yarns from an outlet of the spinning machine to form the core thread, where the thermoplastic polyurethane colloidal particles are hot melted and then wrapped around the peripheral side of the core thread obtained from the outlet to form a first-stage thread;

(D) shaping a surface of the first-stage thread by performing first cooling on the first-stage thread;

(E) stretching and extending the cooled first-stage thread by using a tensile device;

(F) repeating step (A) and step (B) on the first-stage thread, and wrapping the mixed material around a periphery of the first-stage thread;

(G) shaping an inside of the first-stage thread by performing second cooling on the first-stage thread, to form a second-stage thread; and (I) collecting the second-stage thread to form a deodorant and antibacterial nano copper fiber yarn, where the deodorant and antibacterial nano copper fiber yarn is the first fiber thread or the first fiber thread and the second fiber thread.

In an embodiment, the first cooling in step D means that the first-stage thread continuously passes through a cooling tank over a period of time, and the second cooling in step G is natural air cooling.

In an embodiment, a standard reduction potential of the first metal ions is greater than a standard reduction potential of the second metal in an ionic state, and a standard reduction potential difference of the first metal ions is 0.4-4 volts greater than a standard reduction potential difference of the second metal in the ionic state.

In an embodiment, a temperature for drying in step C is controlled between 100° C. and 150° C.

In an embodiment, in step E, the tensile device includes a plurality of roller sets arranged in sequence to stretch the first-stage thread.

As shown in FIG. 6, a method for forming the single-thread yarn in this embodiment includes the following steps:

(A) mixing and stirring the blended slurry and the nano metal solution to form a mixed material, where the nano metal solution includes first metal ions and comes into contact with the blended slurry to form a first metal ion fiber including the first metal ions;

(B) bringing a second metal into contact with the first metal ion fiber, so that the first metal ions undergo a reduction reaction to obtain a nano copper fiber yarn, where the nano copper fiber yarn includes first metal nanoparticles obtained by means of the reduction of the first metal ions;

(C) drying the mixed material to remove moisture, and performing hot-melt spinning on the mixed material in a spinning machine, to obtain yarns from an outlet of the spinning machine to form the single-thread yarn;

(D) shaping the single-thread yarn by performing cooling on the single-thread yarn; and (E) collecting the single-thread yarn, where the single-thread yarn is the second fiber thread.

In an embodiment, the cooling in step D means that the single-thread yarn continuously passes through a cooling tank over a period of time.

In an embodiment, a standard reduction potential of the first metal ions is greater than a standard reduction potential of the second metal in an ionic state, and a standard reduction potential difference of the first metal ions is 0.4-4 volts greater than a standard reduction potential difference of the second metal in the ionic state.

In an embodiment, a temperature for drying in step C is controlled between 100° C. and 150° C.

Figure 7:
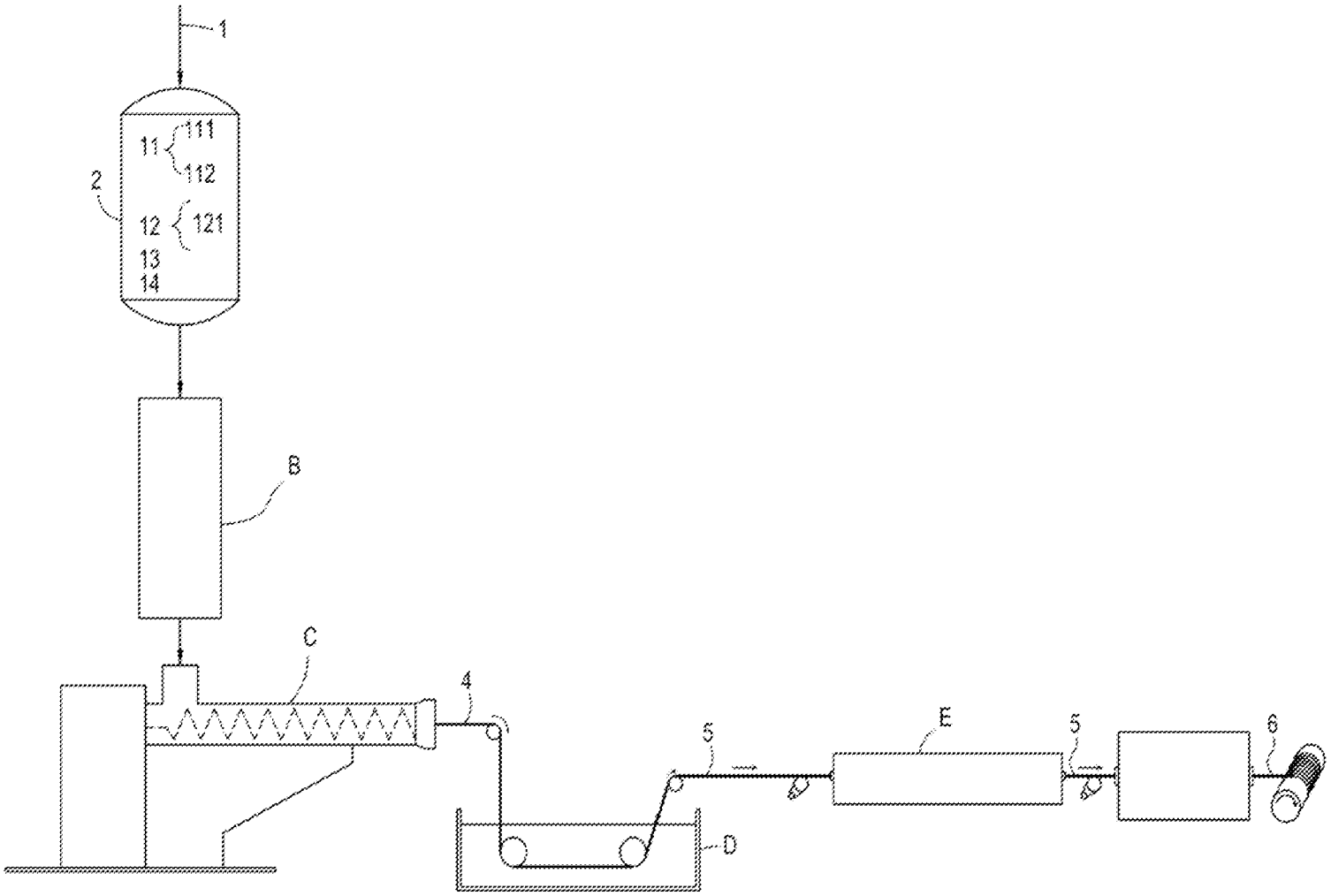
FIG. 7 is a diagram of a device system corresponding to a method for manufacturing a deodorant and antibacterial nano copper fiber yarn according to an embodiment of this application.

As shown in FIG. 7, a device system corresponding to a method for manufacturing a deodorant and antibacterial nano copper fiber yarn in this embodiment provides a raw material 1. The raw material 1 includes a blended slurry 11, a nano metal solution 12, a plurality of inorganic particles 13, and a plurality of thermoplastic polyurethane colloidal particles 14. The blended slurry 11 includes a first fiber yarn slurry 111 and a second fiber yarn slurry 112. The nano metal solution 12 includes first metal ions 121.

Further, the raw material 1 is mixed and stirred in a mixing tank 11 to form a mixed material 2, so that the nano metal solution 12 comes into contact with the blended slurry 11 to form a first metal ion fiber 21 including the first metal ions.

Further, a second metal 3 is brought into contact with the first metal ion fiber 21, so that the first metal ions undergo a reduction reaction. Thus, the first metal ion fiber 21 obtains electrons so as to obtain the nano copper fiber yarn. The nano copper fiber yarn includes first metal nanoparticles obtained by means of the reduction of the first metal ions.

In an embodiment, the second metal may include magnesium, aluminum, manganese, titanium, zinc, iron, nickel, tin, copper, or silver.

Further, the mixed material 2 is dried to remove moisture. The drying operation may be performed in an oven B, and a temperature in the oven B may be controlled between 100° C. and 150° C. However, the temperature control is not limited thereto.

Further, the mixed material 2 is delivered to a spinning machine C, and hot-melt spinning is performed on the mixed material 2 by using the spinning machine C, so as to obtain a yarn 4 from an outlet of the spinning machine C to form a primary thread. The thermoplastic polyurethane colloidal particles 14 are hot melted by the spinning machine C, and then may be further wrapped around a peripheral side of the primary thread at the outlet of the spinning machine C (shown in FIG. 8), so as to form a first-stage thread 5.

Further, the first-stage thread 5 is delivered to a cooling tank D for forced cooling, which is first cooling, so as to shape a surface of the first-stage thread 5.

Further, the first-stage thread 5 after the first cooling is delivered to a tensile device E for stretching and extending the cooled first-stage thread 5, so as to control a thread diameter to be proper.

In an embodiment, the tensile device E includes a plurality of roller sets arranged in sequence, and the first-stage thread 5 is wound around the roller sets for stretching, so as to control the thread diameter.

Further, second cooling such as natural air cooling is performed on the first-stage thread 5. By means of the cooling, an inside of the first-stage thread 5 can be shaped to form a second-stage thread 6.

Further, the second-stage thread 6 is collected. For example, the second-stage thread 6 may be wound into a roll shape by winding the yarns, so as to form a deodorant and antibacterial nano copper fiber yarn product.

Further, the first fiber yarn slurry 111 may be one from a group consisting of a cotton fiber, a polyester fiber, a viscose fiber, and a Modal fiber, such as a single fiber or a combination of any of the foregoing fibers.

Figure 8:
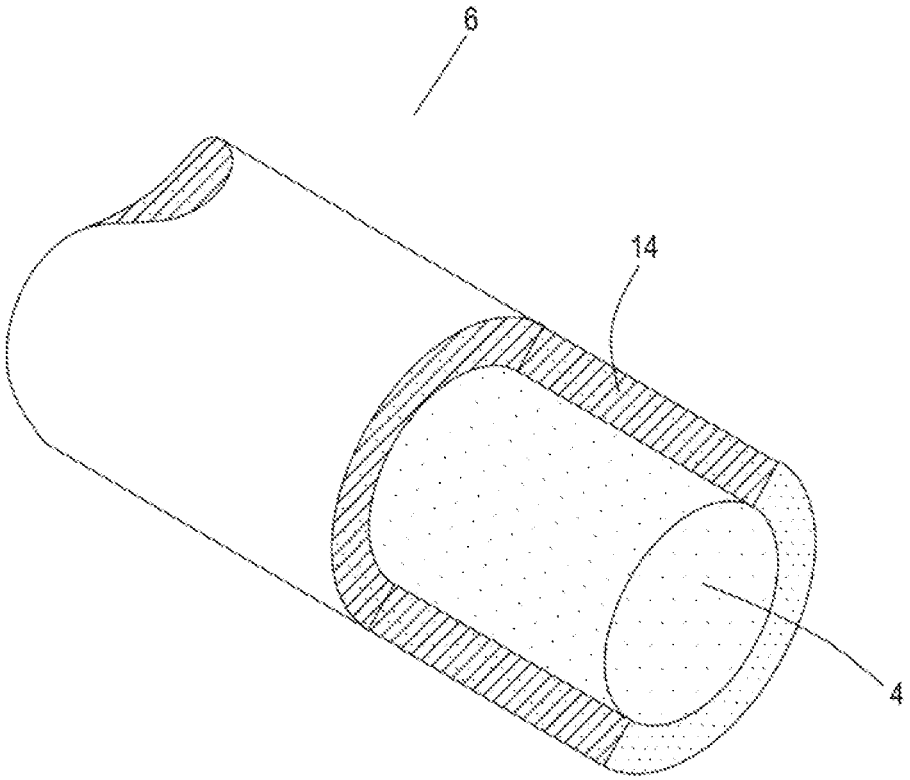
FIG. 8 is a three-dimensional schematic cross-sectional view of a deodorant and antibacterial nano copper fiber yarn according to an embodiment of this application.

As shown in FIG. 8, the deodorant and antibacterial nano copper fiber yarn in this embodiment is the second-stage thread 6 manufactured by using the manufacturing method in the foregoing embodiments. An average particle size of the first metal nanoparticles is 1 nanometer to 100 nanometers. In addition, a content of the first metal nanoparticles included in the nano copper fiber yarn in the second-stage thread 6 is 10 micrograms to 100 micrograms per square centimeter of a fiber surface.

By means of the method for manufacturing a protective cloth with moisture permeability in the embodiments of this application, a protective cloth with moisture permeability can be manufactured.

According to the above, this application provides a high-level protective cloth with excellent moisture permeability and protective performance.

The foregoing embodiments are merely intended for describing the technical solutions of this application, but not for limiting this application. Although this application is described in detail with reference to the foregoing embodiments, a person of ordinary skill in the art is to understand that modifications may still be made to the technical solutions described in the foregoing embodiments or equivalent replacements may be made to some technical features thereof, as long as such modifications or replacements do not cause the essence of corresponding technical solutions to depart from the spirit and scope of the technical solutions of the embodiments of this application.

What is claimed is:

1. A method for manufacturing a protective cloth with moisture permeability, comprising the following steps:

providing a first fiber thread and a second fiber thread, wherein the first fiber thread is a core-spun yarn formed by a blended slurry, a nano metal solution, a plurality of inorganic particles, and a plurality of thermoplastic polyurethane colloidal particles, the thermoplastic polyurethane colloidal particles are hot melted and then wrapped around a peripheral side of a core thread of the core-spun yarn for isolation from an outer wrapping layer of the core-spun yarn, and the second fiber thread is the same as the first fiber thread or is a single-thread yarn formed by the blended slurry and the nano metal solution;

respectively forming a moisture-permeable membrane on a surface of an arrangement layer formed by the first fiber thread and a surface of an arrangement layer formed by the second fiber thread; and combining the first fiber thread and the second fiber thread in pairs by intersecting and laminating to form laminated bonding, wherein the first fiber thread and the second fiber thread with the moisture-permeable membrane are used as two opposite surface layers of the laminated bonding to allow the laminated bonding to form a corresponding moisture-permeable membrane layer.

2. The method of claim 1, wherein formation of the moisture-permeable membrane further comprises one or more of the following:

forming the moisture-permeable membrane between one or more pairs of the first fiber thread and the second fiber thread; and forming the moisture-permeable membrane between some or all of adjacent pairs.

3. The method of claim 1, wherein the step of respectively forming a moisture-permeable membrane on a surface of an arrangement layer formed by the first fiber thread and a surface of an arrangement layer formed by the second fiber thread comprises: respectively contacting the surface of the arrangement layer formed by the first fiber thread and the surface of the arrangement layer formed by the second fiber thread with a high-molecular-weight polyethylene spinning solution and then cooling, to respectively form the moisture-permeable membrane on the surface of the arrangement layer formed by the first fiber thread and the surface of the arrangement layer formed by the second fiber thread.

4. The method of claim 1, wherein an arrangement angle of each pair of the first fiber thread and the second fiber thread is orthogonal, and arrangement modes of adjacent pairs are different.

5. The method of claim 1, wherein a method for forming the core-spun yarn comprises the following steps:

(A) mixing and stirring the blended slurry, the nano metal solution, the inorganic particles, and the thermoplastic polyurethane colloidal particles to form a mixed material, wherein the nano metal solution comprises first metal ions and comes into contact with the blended slurry to form a first metal ion fiber comprising the first metal ions;

(B) bringing a second metal into contact with the first metal ion fiber, so that the first metal ions undergo a reduction reaction to obtain a nano copper fiber yarn, wherein the nano copper fiber yarn comprises first metal nanoparticles obtained by means of the reduction of the first metal ions;

(C) drying the mixed material to remove moisture, and performing hot-melt spinning on the mixed material in a spinning machine, to obtain yarns from an outlet of the spinning machine to form the core thread, wherein the thermoplastic polyurethane colloidal particles are hot melted and then wrapped around the peripheral side of the core thread obtained from the outlet to form a first-stage thread;

(D) shaping a surface of the first-stage thread by performing first cooling on the first-stage thread;

(E) stretching and extending the cooled first-stage thread by using a tensile device;

(F) repeating step (A) and step (B) on the first-stage thread, and wrapping the mixed material around a periphery of the first-stage thread;

(G) shaping an inside of the first-stage thread by performing second cooling on the first-stage thread, to form a second-stage thread; and (I) collecting the second-stage thread to form a deodorant and antibacterial nano copper fiber yarn, wherein the deodorant and antibacterial nano copper fiber yarn is the first fiber thread or the first fiber thread and the second fiber thread.

6. The method of claim 1, wherein a method for forming the single-thread yarn comprises the following steps:

(A) mixing and stirring the blended slurry and the nano metal solution to form a mixed material, wherein the nano metal solution comprises first metal ions and comes into contact with the blended slurry to form a first metal ion fiber comprising the first metal ions;

(B) bringing a second metal into contact with the first metal ion fiber, so that the first metal ions undergo a reduction reaction to obtain a nano copper fiber yarn, wherein the nano copper fiber yarn comprises first metal nanoparticles obtained by means of the reduction of the first metal ions;

(C) drying the mixed material to remove moisture, and performing hot-melt spinning on the mixed material in a spinning machine, to obtain yarns from an outlet of the spinning machine to form the single-thread yarn;

(D) shaping the single-thread yarn by performing cooling on the single-thread yarn; and (E) collecting the single-thread yarn to form the second fiber thread.

7. The method of claim 1, wherein the blended slurry comprises a first fiber yarn slurry and a second fiber yarn slurry, the first fiber yarn slurry is selected from a cotton fiber, a polyester fiber, a viscose fiber and a Modal fiber, an ultra-high-molecular-weight polyethylene fiber, and a polypropylene fiber, and the second fiber yarn slurry is selected from an aromatic polyamide fiber, a polyamide fiber, a polyethylene terephthalate fiber, a polyethylene naphthalate fiber, an extended-chain polyvinyl alcohol fiber, an extended-chain polyacrylonitrile fiber, a polybenzoxazole fiber, a polybenzothiazole fiber, a liquid-crystal copolyester fiber, a rigid-rod fiber, a glass fiber, a structural glass fiber, and a resistant glass fiber.

8. The method of claim 1, wherein the thermoplastic polyurethane colloidal particles comprise thermoplastic polyurethane, polyethylene, polypropylene, polyethylene terephthalate, polyamide, polybutylene terephthalate, an ethylene-vinyl acetate copolymer or nylon, and copper modified polyacrylonitrile.

9. The method of claim 1, wherein the plurality of inorganic particles is rare earth or mineral particle powder.

10. The method of claim 5, wherein the first metal ions are copper ions, and the second metal comprises magnesium, aluminum, manganese, titanium, zinc, iron, nickel, tin, copper, or silver.

11. The method of claim 6, wherein the first metal ions are copper ions, and the second metal comprises magnesium, aluminum, manganese, titanium, zinc, iron, nickel, tin, copper, or silver.

12. The method of claim 5, wherein a standard reduction potential of the first metal ions is greater than a standard reduction potential of the second metal in an ionic state, and a standard reduction potential difference of the first metal ions is 0.4-4 volts greater than a standard reduction potential difference of the second metal in the ionic state.

13. The method of claim 5, wherein a temperature for drying in step C is controlled between 100° C. and 150° C.

14. The method of claim 6, wherein a temperature for drying in step C is controlled between 100° C. and 150° C.

15. The method of claim 5, wherein the first cooling in step D means that the first-stage thread continuously passes through a cooling tank over a period of time, and the second cooling in step G is natural air cooling.

16. The method of claim 6, wherein the cooling in step D means that the single-thread yarn continuously passes through a cooling tank over a period of time.

17. The method of claim 5, wherein in step E, the tensile device comprises a plurality of roller sets arranged in sequence to stretch the first-stage thread.

* * * * *